US011560810B1

(12) United States Patent
Argote et al.

(10) Patent No.: US 11,560,810 B1
(45) Date of Patent: Jan. 24, 2023

(54) VARIABLE VANE ACTUATION SYSTEM AND METHOD FOR GAS TURBINE ENGINE PERFORMANCE MANAGEMENT

(71) Applicant: Rolls-Royce North American Technologies Inc., Indianapolis, IN (US)

(72) Inventors: Christopher Argote, Danville, IN (US); Aaron King, Greenwood, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 0 days.

(21) Appl. No.: 17/380,370

(22) Filed: Jul. 20, 2021

(51) Int. Cl.
*F01D 21/00* (2006.01)
*F01D 17/16* (2006.01)

(52) U.S. Cl.
CPC ..... *F01D 21/003* (2013.01); *F01D 17/162* (2013.01); *F05D 2260/80* (2013.01); *F05D 2260/83* (2013.01); *F05D 2270/301* (2013.01); *F05D 2270/303* (2013.01); *F05D 2270/3061* (2013.01)

(58) Field of Classification Search
CPC .. F01D 21/003; F01D 17/162; F05D 2260/80; F05D 2260/83; F05D 2270/301; F05D 2270/303; F05D 2270/3061
See application file for complete search history.

(56) References Cited

U.S. PATENT DOCUMENTS

| | | | | |
|---|---|---|---|---|
| 3,397,836 | A | 8/1968 | Badger et al. | |
| 3,914,066 | A | 10/1975 | Downing | |
| 5,044,879 | A | 9/1991 | Farrar | |
| 5,692,879 | A | 12/1997 | Charbonnel | |
| 5,993,152 | A | 11/1999 | Schilling | |
| 6,092,984 | A * | 7/2000 | Bouyer | F16F 7/104 415/150 |
| 7,037,070 | B2 * | 5/2006 | Raine | F04D 27/0246 415/149.4 |
| 7,413,401 | B2 * | 8/2008 | Szucs | F01D 17/162 415/162 |
| 8,204,671 | B2 | 6/2012 | Agrawal et al. | |
| 8,297,918 | B2 | 10/2012 | Bhatnagar | |
| 8,333,546 | B2 | 12/2012 | Colotte et al. | |
| 8,727,697 | B2 * | 5/2014 | Eifert | F04D 29/563 415/1 |
| 8,740,547 | B2 | 6/2014 | Colotte et al. | |
| 10,301,962 | B2 | 5/2019 | Chandler et al. | |
| 10,508,660 | B2 * | 12/2019 | Hall | F04D 29/563 |
| 10,634,000 | B2 | 4/2020 | Skertic et al. | |
| 10,662,804 | B2 | 5/2020 | Awtry et al. | |
| 10,815,802 | B2 | 10/2020 | Prasad | |

(Continued)

*Primary Examiner* — Courtney D Heinle
*Assistant Examiner* — Ryan C Clark
(74) *Attorney, Agent, or Firm* — Barnes & Thornburg LLP

(57) ABSTRACT

A method of maintaining at least one gas turbine engine includes monitoring a compressor of the gas turbine engine. The compressor includes a compressor case at least partially defining a flow path, a plurality of stages and a vane actuator system configured to move at least one of the stages. The vane actuator system includes a vane mover having one or more slots formed therein and configured to actuate the at least one stage. The vane mover may be replaced after the gas turbine engine has experienced engine degradation.

17 Claims, 3 Drawing Sheets

(56) References Cited

U.S. PATENT DOCUMENTS

| | | | | |
|---|---|---|---|---|
| 10,927,699 | B2 | 2/2021 | Bromann et al. | |
| 11,168,578 | B2 * | 11/2021 | Farrell | F01D 17/16 |
| 2006/0024153 | A1 * | 2/2006 | Regunath | F04D 27/0215 415/159 |
| 2013/0136575 | A1 * | 5/2013 | Potel | F01D 17/06 415/1 |
| 2016/0040550 | A1 * | 2/2016 | Do | F04D 27/002 415/13 |
| 2016/0123238 | A1 * | 5/2016 | Kay | F01D 9/041 415/118 |
| 2017/0002682 | A1 * | 1/2017 | Lau | F01D 21/003 |
| 2017/0292400 | A1 * | 10/2017 | Bifulco | F01D 17/085 |
| 2018/0030851 | A1 * | 2/2018 | Emmons | F04D 27/001 |
| 2018/0058246 | A1 * | 3/2018 | Keenan | F01D 9/042 |
| 2018/0171878 | A1 * | 6/2018 | Mojem | F16C 3/12 |
| 2019/0112941 | A1 * | 4/2019 | Karapurath | F01D 17/162 |
| 2019/0284955 | A1 * | 9/2019 | Kim | F01D 17/08 |
| 2020/0080441 | A1 * | 3/2020 | Farrell | F01D 17/08 |
| 2020/0080444 | A1 * | 3/2020 | Warren | F01D 21/003 |

* cited by examiner

VARIABLE VANE ACTUATION SYSTEM AND METHOD FOR GAS TURBINE ENGINE PERFORMANCE MANAGEMENT

FIELD OF THE DISCLOSURE

The present disclosure relates to a system and method for moving variable stator vanes in an engine, such as in a turbine engine for example. In particular, the present disclosure relates to a system and method for moving variable stator vanes to maintain efficiencies of the engine.

BACKGROUND

Variable pitch stator vanes can be used in a compressor section or other sections of gas turbine engines. These vanes may be pivotally mounted inside a case of the turbine engine and can be arranged in circumferential rows that are spaced from one another along a center axis of the turbine engine. Each row may correspond to a different stage of the compressor section. Each of the individual vanes may pivot about an axis that extends transverse to the centerline axis. Engine performance and reliability can be enhanced by varying the angle of the vanes relative to rotating blades of the compressor at different stages during the operation of the turbine engine. For example, in a turbine engine applied to aircraft propulsion, obtaining greater thrust can require the compressor section to impart a higher pressure ratio to the fluid moving through the compressor. However, on the other hand, a higher pressure ratio can cause the compressor to stall or surge. Variable pitch stator vanes can be pivoted as the speed of the engine changes to ensure that each vane is in a position to guide the flow angle as a function of rotor speed to counteract the development of stall characteristics.

The compressor section or other sections of the gas turbine engine can degrade over time. After engine degradation, the variable stator vanes may not provide the efficiency levels that the compressor or other section once had prior to degradation. Accordingly, variable stator vanes and their surrounding systems remain an area of development for increasing or maintaining efficiencies over the life of the gas turbine engine.

SUMMARY

The present disclosure may comprise one or more of the following features and combinations thereof.

According to one aspect of the present disclosure, a method of maintaining at least one gas turbine engine includes providing a compressor of the gas turbine engine. The compressor may include: (i) a compressor case at least partially defining a flow path, (ii) a plurality of stages including a first stage of variable vanes extending into the flow path and a second stage of variable vanes extending into the flow path and spaced apart from the first stage of variable vanes, and (iii) a vane actuator system including a pair of vane rings, each vane ring coupled to each variable vane of a corresponding stage of variable vanes, an actuator configured to move each vane ring based on engine operating conditions, and a vane mover interconnecting the actuator and each vane ring to transfer movement of the actuator to each of the vane rings, the vane mover including a first-stage slot providing a first movement path for the first stage of variable vanes and a second-stage slot providing a second movement path for the second stage of variable vanes.

In some embodiments, the method includes monitoring the compressor for degradation by measuring at least one of temperature, pressure, and flow rate in the gas turbine engine and comparing the at least one of temperature, pressure and flow rate to a threshold value.

In some embodiments, the method includes testing the gas turbine engine after the threshold value is reached to determine a performance sensitivity of the compressor by actuating the first and second stages of vanes and collecting pressure values and flow rate values at each stage.

In some embodiments, the method includes forming a bespoke vane mover based on the performance sensitivity of the compressor, the bespoke vane mover having an adjusted first-stage slot providing a third movement path for the first stage of variable vanes different than the first movement path and an adjusted second-stage slot providing a fourth movement path different than the second movement path.

In some embodiments, the method includes replacing the vane mover in the compressor with the bespoke vane mover to increase an efficiency of the compressor without replacing the first stage of variable vanes or the second stage of variable vanes.

In some embodiments, the method includes obtaining operation history of the gas turbine engine including at least one of flight history, location history, rest history, and service history.

In some embodiments, the step of forming the bespoke vane mover is based on both the performance sensitivity and the operation history of the gas turbine engine.

In some embodiments, the method includes storing the performance sensitivity and the bespoke vane mover design in a database and associating the performance sensitivity with the bespoke vane mover design in the database.

In some embodiments, the method includes replacing a vane mover of a second gas turbine engine having a substantially similar operation history or performance sensitivity with a second bespoke vane mover having substantially similar adjusted first-stage and second-stage slots.

In some embodiments, the step of testing includes pivoting each of the first-stage variable vanes and each of the second stage variable vanes, measuring responses of the compressor to determine test values indicative of the performance sensitivity of the compressor, and comparing the test values to predetermined, initial values of the compressor indicative of engine performance when the compressor has no engine degradation.

In some embodiments, the step of testing is performed while the engine is mounted on an airframe of an aerial vehicle and the step of pivoting each of the first stage variable vane and each of the second stage variable vanes includes installing a series of diagnostic vane movers each having different movement paths, and the step of comparing includes comparing test values for each diagnostic vane mover.

In some embodiments, the step of testing includes removing the gas turbine engine from an airframe of an aerial vehicle and the step of pivoting is performed by an individual actuator for each stage of variable vanes.

According to another aspect of the present disclosure, a method includes operating a compressor of a gas turbine engine. The compressor may include (i) a compressor case at least partially defining a flow path, (ii) a plurality of stages including a first stage of variable vanes extending into the flow path and a second stage of variable vanes extending into the flow path and spaced apart from the first stage of variable vanes, and (iii) a vane actuator system including a pair of vane rings, each vane ring coupled to each variable vane of a corresponding stage of variable vanes, an actuator configured to move each vane ring based on engine operating conditions, and a vane mover interconnecting the actuator and each vane ring to transfer movement of the actuator to each of the vane rings, the vane mover including a first-stage slot providing a first movement path for the first stage of variable vanes and a second-stage slot providing a second movement path for the second stage of variable vanes.

In some embodiments, the method includes replacing the first vane mover with a second vane mover having different movement paths than the first vane mover, and In some embodiments, the method includes operating the compressor of the gas turbine engine after the replacing step.

In some embodiments, the method includes determining that the gas turbine engine has experienced degradation by measuring at least one of temperature, pressure, and flow rate in the gas turbine engine and comparing the at least one of temperature, pressure and flow rate to a threshold value and testing the gas turbine engine after the threshold value is reached to determine a performance sensitivity of the compressor by actuating the first and second stages of vanes and collecting pressure values and flow rate values at each stage.

In some embodiments, the method includes forming the second vane mover based on the performance sensitivity, the second vane mover having an adjusted first-stage slot providing a third movement path for the first stage of variable vanes different than the first movement path and an adjusted second-stage slot providing a fourth movement path different than the second movement path.

In some embodiments, the method includes a step of obtaining an operation history of the gas turbine engine including at least one of flight history, location history, rest history, and service history.

In some embodiments, the step of forming the second vane mover is based on the performance sensitivity and the operation history of the gas turbine engine.

In some embodiments, the method includes a step of storing the performance sensitivity and the bespoke vane mover design in a database and associating the performance sensitivity with the second vane mover design in the database.

In some embodiments, the method includes a step of replacing a vane mover of a second gas turbine engine having a substantially similar operation history or performance sensitivity with a copy of the second vane mover having substantially similar adjusted first-stage and second-stage slots.

In some embodiments, the step of testing includes pivoting each of the first-stage variable vanes and each of the second stage variable vanes, measuring responses of the compressor to determine test values indicative of the performance sensitivity of the compressor, and comparing the test values to predetermined, initial values of the compressor indicative of engine performance when the compressor has no engine degradation.

In some embodiments, the adjusted first-stage slot and the adjusted second-stage slot cause the gas turbine engine to return to an efficiency level above what the gas turbine engine had prior to replacing the vane mover with the bespoke vane mover.

According to another aspect of the present disclosure, a gas turbine engine kit includes a compressor for a gas turbine engine and a bespoke vane mover. The compressor may include: (i) a compressor case at least partially defining a flow path, (ii) a plurality of stages including a first stage of variable vanes extending into the flow path and a second stage of variable vanes extending into the flow path and spaced apart from the first stage of variable vanes, and (iii) a vane actuator system including a pair of vane rings, each vane ring coupled to each variable vane of a corresponding stage of variable vanes, an actuator configured to move each vane ring based on engine operating conditions, and a vane mover interconnecting the actuator and each vane ring to transfer movement of the actuator to each of the vane rings, the vane mover including a first-stage slot providing a first movement path for the first stage of variable vanes and a second-stage slot providing a second movement path for the second stage of variable vanes.

In some embodiments, the bespoke vane mover has an adjusted first-stage slot providing a third movement path for the first stage of variable vanes different than the first movement path and an adjusted second-stage slot providing a fourth movement path different than the second movement path.

In some embodiments, the first stage slot has a first slope relative to circumferential edges of the vane mover and the adjusted first-stage slot has a second slope different than the first slope, and wherein the second stage slot has a third slope relative to circumferential edges of the vane mover and the adjusted first-stage slot has a fourth slope different than the third slope.

In some embodiments, the first stage slot has a first curvature relative to circumferential edges of the vane mover and the adjusted first-stage slot has a second curvature different than the first curvature, and wherein the second stage slot has a third curvature relative to circumferential edges of the vane mover and the adjusted first-stage slot has a fourth curvature different than the third curvature.

These and other features of the present disclosure will become more apparent from the following description of the illustrative embodiments.

DETAILED DESCRIPTION

Figure 1:
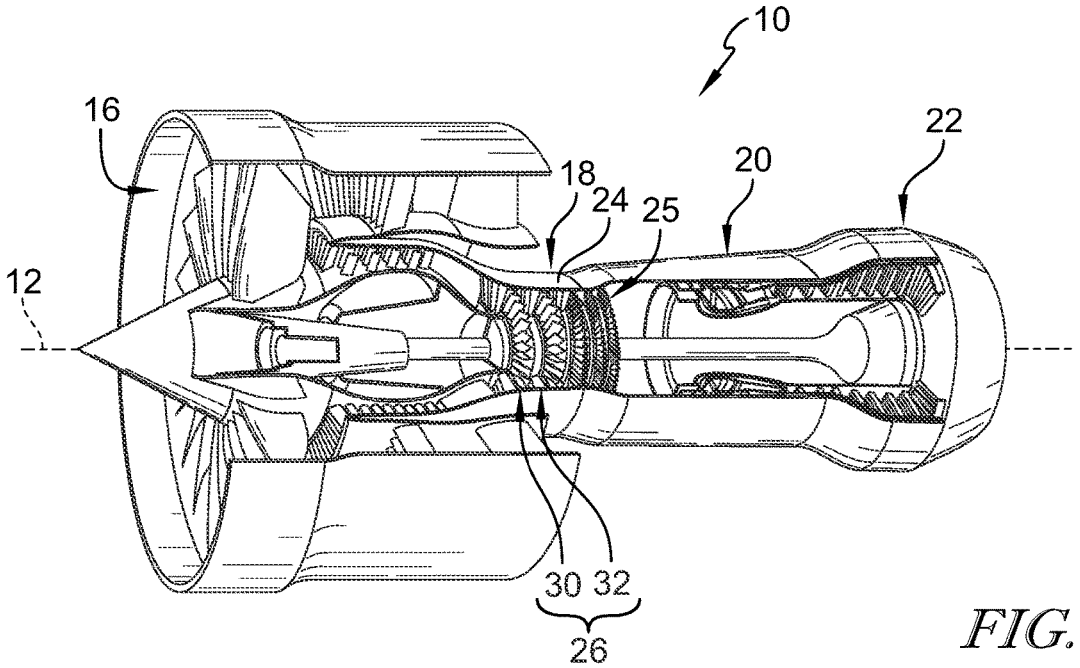
FIG. 1 is a perspective view of a gas turbine engine including a compressor having a plurality of axially-spaced stages of variable stator vanes and a plurality of axially-spaced stages of rotating blades that rotate about a central axis of the gas turbine engine.

For the purposes of promoting an understanding of the principles of the disclosure, reference will now be made to a number of illustrative embodiments illustrated in the drawings and specific language will be used to describe the same.

An illustrative gas turbine engine 10, in accordance with the present disclosure, is shown in FIG. 1. The gas turbine engine 10 includes a compressor 18, a combustor 20, and a turbine 22. The compressor 18 is configured to pressurize air and delivers the pressurized air to the combustor 20 during operation. Fuel is injected into the combustor 20 and is ignited with the pressurized air to produce hot, high pressure gases which are discharged from the combustor 20 toward the turbine 22. The hot, high pressure gases drive rotation of rotating components (i.e. blades and disks) in the turbine 22 about a central axis 12 of the gas turbine engine 10. In some embodiments, the gas turbine engine 10 further includes a fan 16 to provide thrust for the gas turbine engine 10.

Figure 2:
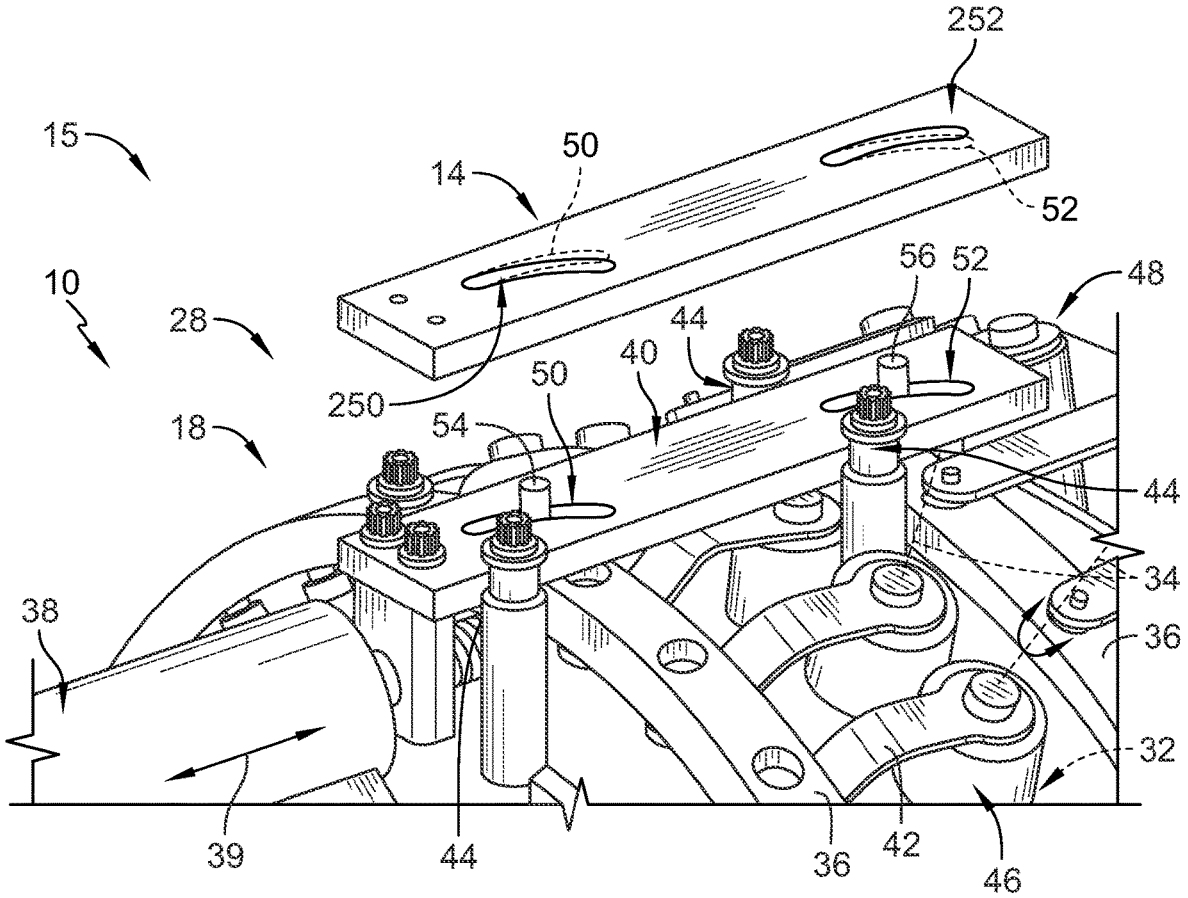
FIG. 2 is an enlarged view of a portion of the compressor including an actuator, a first stage of variable vanes, a second stage of variable vanes spaced apart from the first stage of variable vanes, and a vane mover coupled to the actuator and extending between and interconnecting the first stage of variable vanes and the second stage of variable vanes to transfer movement of the actuator to both the first stage of variable vanes and the second stage of variable vanes, and suggesting that the vane mover may be replaced with a bespoke vane mover configured to cause the first stage of variable vanes and the second stage of variable vanes to move along different paths compared to the original vane mover to return the compressor to a higher efficiency to mitigate engine degradation present in the compressor.

The fan 16 and the compressor 18 may be divided into a plurality of sections in the gas turbine engine 10 and may be coupled to different spools or shafts of the gas turbine engine 10 for rotation about the central axis 12. The compressor 18 includes a compressor case 24, a plurality of stages 26, and a vane actuator system 28 as shown in FIGS. 1 and 2. The compressor case 24 extends around the central axis 12 and defines an interior compressor flow path 25. The plurality of stages 26 are spaced axially from one another and configured to cooperate with one another to pressurize the air entering the engine core to a level at which it may be ignited downstream in the combustor 20. Each stage 26 includes a plurality of stator vanes 32 and a plurality of rotating blades 30 that are driven in rotation by the turbine 22 to pressurize the air. The plurality of stator vanes 32 are configured to guide the air toward to the plurality of rotating blades 30 to maximize an efficiency of the compressor 18. The plurality of rotating blades 30 intercept the air guided by the plurality of stator vanes 32 and push the air further downstream toward additional stage(s) 26 and the combustor 20.

The plurality of stator vanes 32, in the illustrative embodiment, are variable stator vanes 32 that can each be pivoted about a radial axis 34 relative to central axis 12 to change an angle of each variable vane 32 relative to the corresponding plurality of rotating blades 30 of each stage 26 as shown in FIG. 2. The vane actuator system 28 is configured to drive each of the plurality of stator vanes 32 to pivot about their respective axis 34 to adjust performance of the compressor 18 based on operating conditions of the gas turbine engine 10, such as engine speed, thrust, load, etc.

The vane actuator system 28 includes a vane ring 36 coupled to each of the variable vanes 32 of a corresponding stage 26, an actuator 38, and a vane mover 40 interconnecting the vane ring 36 and the actuator 38 as shown in FIG. 2. The vane ring 36 extends circumferentially about central axis 12 and may be rotated by the vane mover 40 to adjust the angle of each vane 32 of the corresponding stage 26 relative to the rotating blades 30 of the corresponding stage 26 based on engine operating conditions. The actuator 38 is a linear actuator in the illustrative embodiment and is configured to move the vane mover axially forward and aft based on the engine operating conditions. The vane mover 40 is configured to transfer movement of the actuator 38 to the vane ring 36 to cause rotation of the vane ring about the central axis 12. Each variable vane 32 is coupled to the vane ring 36 by a link 42 to drive rotation of each variable vane 32 in unison as the actuator 38 moves the vane mover 40 to rotate the vane ring 36.

The vane mover 40 in the illustrative embodiment is a plate that is supported by a plurality of bushings 44 to guide linear movement of the actuator 38 forward and aft as shown in FIG. 2. The vane mover 40 extends between a plurality of stages 26 to pivot the variable vanes 32 of each corresponding stage 26 in unison as the vane mover 40 is actuated by the actuator 38. The vane mover 40 extends between a first stage of variable vanes 46 and a second stage of variable vanes 48.

Each stage of variable vanes 46, 48 includes its own vane ring 36 that is coupled to the vane mover 40. The vane mover 40 is formed to include a first-stage guide slot 50 corresponding to the first stage of variable vanes 46 and a second-stage guide slot 52 corresponding to the second stage of variable vanes 48. Each vane ring 36 includes a guide pin 54, 56 that extends through the a first-stage guide slot 50 and the second-stage guide slot 52, respectively. The first-stage guide slot 50 and the second-stage guide slot 52 are shaped to cause circumferential movement of the vane rings 36 as the guide pins 54, 56 travel through each corresponding guide slot 50, 52 during actuation of the actuator 38. Although the vane mover 40 interconnects only two stages 26 of the compressor 18 in the illustrative embodiment, it should be appreciated that the vane mover 40 may interconnect more than two stages of the compressor 18. In such an embodiment, the vane mover 40 may have a corresponding guide slot for each stage 26 that the vane mover 40 is coupled to.

The first-stage guide slot 50 provides a first movement path for the first stage of variable vanes 46. The second-stage slot 52 provides a second movement path for the second stage of variable vanes 48. In the illustrative embodiment, the first and second movement paths are different from one another. Each stage 26 of the compressor 18 is designed so that the variable vanes 32 of each stage 26 move relative to the rotating blades 30 of each stage 26 to maximize an efficiency of the compressor 18 at each stage 26 across all engine operating conditions (i.e. speed).

In some embodiments, the first movement path may cause the first stage of variable vanes 46 to pivot a greater amount compared to the second stage of variable vanes 46 as the actuator 38 moves the vane mover 40 between a fully-retracted position and a fully-extended position. In other embodiments, the first movement path may cause the first stage of variable vanes 46 to pivot a smaller amount compared to the second stage of variable vanes 46 as the actuator 38 moves the vane mover 40 between the fully-retracted position and the fully-extended position. In other embodiments, the first movement path and the second movement path are the same or similar to one another to cause the first and second stages of variable vanes 46, 48 to pivot the same amount as the actuator 38 moves the vane mover 40. In the illustrative embodiment, the fully-retracted position of the actuator corresponds to a first flow rate between the vanes 32 and a first angle of the vanes 32 relative to the rotating blades 30 and the fully-extended position corresponds to a second flow rate between the vanes 32 and a second angle of the vanes 32 relative to the rotating blades 30. The first flow rate is greater than the second flow rate and the first angle is greater than the second angle relative to the plurality of rotating blades. The fully-retracted position may correspond to high speed conditions of the gas turbine engine 10 while the fully-extended position may correspond to low speed condition of the gas turbine engine. It should be appreciated that these characteristics can be achieved with differently shaped and oriented slots 50, 52 and by altering the interaction of the vane mover 40 with the actuator 38 in the fully-retracted position and the fully-extended position or any position therebetween.

The compressor 18 or other parts of the gas turbine engine 10 may degrade through normal use over time thereby causing the efficiency of the compressor and/or the gas turbine engine 10 to decrease. This may cause the gas turbine engine 10 to burn more fuel to compensate for the degradation. Burning more fuel may also increase a temperature of the gas turbine engine 10, thereby increasing degradation of the gas turbine engine 10 further. In accordance with the present disclosure, the gas turbine engine 10 may be a part of a kit 15 including the gas turbine engine 10 and a bespoke vane mover 14 that replaces the original vane mover 40 to return the gas turbine engine 10 to a higher efficiency after the gas turbine engine 10 has suffered engine degradation. In this way, an efficiency and life span of the gas turbine engine 10 is increased without having to perform any major overhauls to the gas turbine engine 10, such as replacing the entire compressor 18 or all of the variable vanes 32 and rotating blades 30, for example.

Figure 4:
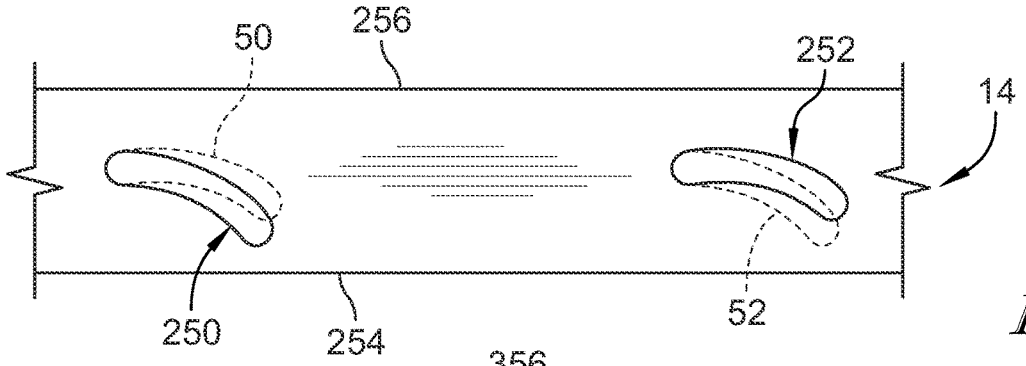
FIG. 4 is a top view of a portion of the vane mover including a first-stage guide slot configured to engage and move the first stage of variable vanes and a second-stage guide slot configured to engage and move the second stage of variable vanes, and showing that the bespoke vane mover may include an adjusted first-stage guide slot and an adjusted second-stage guide slot such that the bespoke vane mover is configured to move the first and second stages of variable vanes along different paths compared to the original vane mover to return the compressor to the higher efficiency.

The bespoke vane mover 14 is substantially similar to the original vane mover 40 included in the gas turbine engine 10, except that the bespoke vane mover 14 has adjusted guide slots 250, 252 that cause the variable vanes 46, 48 of the gas turbine engine 10 to pivot differently as the actuator 38 moves the bespoke vane mover 14 as shown in FIGS. 2 and 4. The bespoke vane mover 14 shown in FIG. 4 has an adjusted first-stage slot 250 corresponding with the first stage of variable vanes 46 and an adjusted second-stage slot 252 corresponding with the second stage of variable vanes 48. The adjusted first-stage slot 250 may provide a third movement path for the first stage of variable vanes 46 different than the first movement path provided by the first-stage slot 50 of the original vane mover 40. The adjusted second-stage slot 252 may provide a fourth movement path for the second stage of variable vanes 48 different than the second movement path provided by the second stage slot 52 of the original vane mover 40.

In the illustrative embodiment, the adjusted first-stage slot 250 has a greater slope compared to the first stage slot 50 of the original vane mover 40. The increased slope causes the first stage of variable vanes 46 to pivot a greater amount about their respective axes 34 as the actuator 38 moves between the fully-retracted position and the fully extended position. In the illustrative embodiment, the adjusted second-stage slot 252 has a smaller slope compared to the second stage slot 52 of the original vane mover 40. The decreased slope causes the second stage of variable vanes 48 to pivot a smaller amount about their respective axes 34 as the actuator 38 moves between the fully-retracted position and the fully extended position. In some embodiments, the adjusted first-stage slot and the adjusted second-stage slot may have any shape or orientation relative to the original slots 50, 52 formed in the vane mover 40 as suggested in FIGS. 5-8. The adjusted first-stage slot 250 has a different curvature compared to the first stage slot 50. The adjusted second-stage slot 252 has a different curvature compared to the second stage slot 52.

Figure 3:
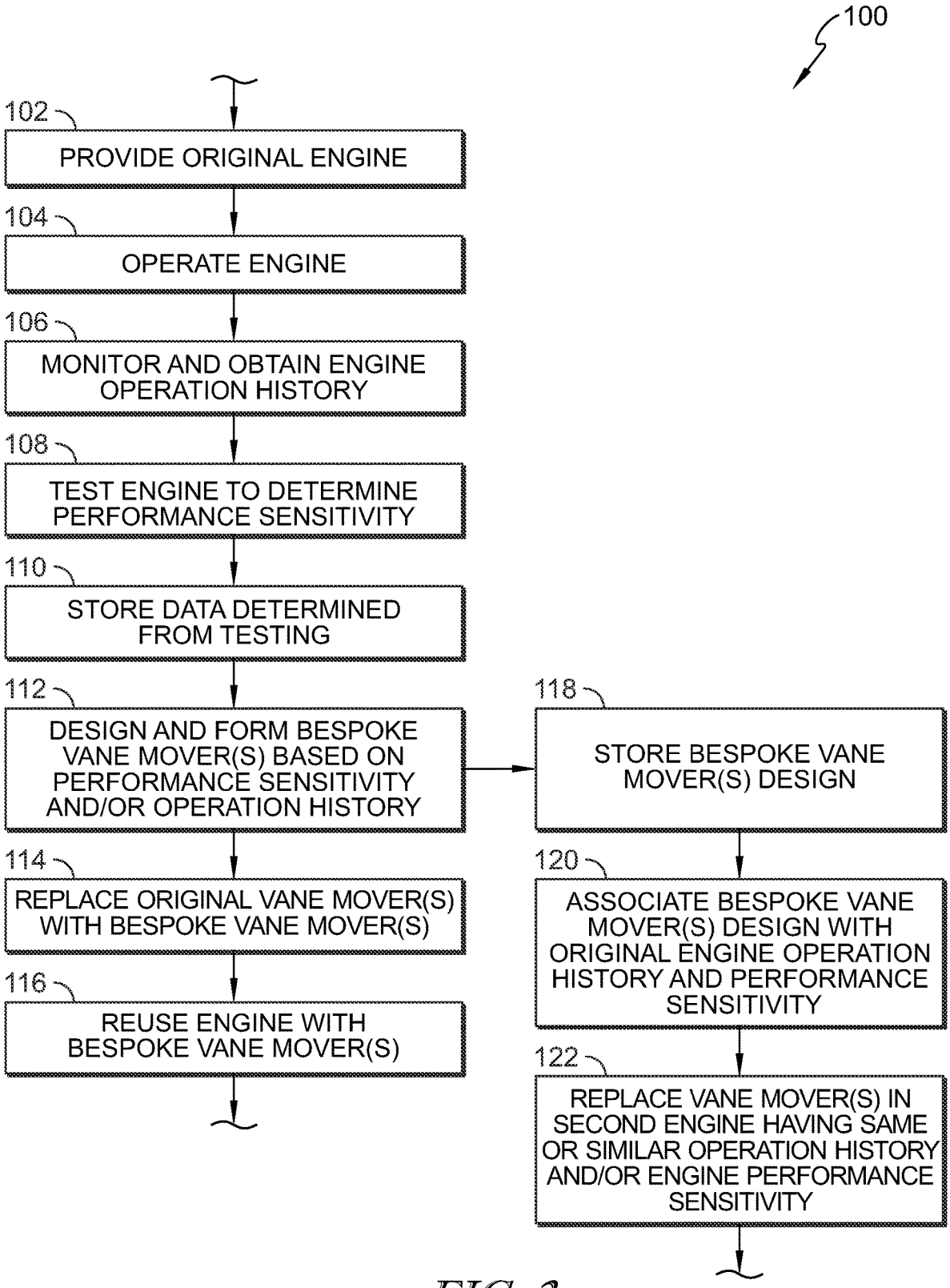
FIG. 3 is a flow chart showing a process for using and servicing the gas turbine engine.

The shape and/or orientation of the adjusted slots formed in the bespoke vane mover 14 are determined as a part of a process 100 of using and maintaining the gas turbine engine 10 as shown in FIG. 3. The gas turbine engine 10 is manufactured or provided at step 102. As originally manufactured, the gas turbine engine 10 includes the vane mover 40 having the original first stage and second stage slots 50, 52. The vane mover 40 may include other slots that correspond to additional stages of variable vanes included in the compressor 18.

The gas turbine engine 10 is then operated for a period of time at step 104. An operation history of the gas turbine engine 10 may be stored for later use in the process 100. The operation history of the gas turbine engine 10 includes all events after the gas turbine engine 10 is manufactured such as, for example, flight history, location history, rest history, service history, etc.

The process 100 further includes a step 106 of monitoring the compressor 18 or other parts of the gas turbine engine 10. The gas turbine engine 10 may be monitored during operation to determine whether and to what extent the compressor 18 has experienced degradation and/or deterioration. In one example, a temperature at an inlet to the turbine 22 is monitored and measured with a sensor, for example. A higher temperature in this part of the gas turbine engine 10 may be associated with and proportional to engine (i.e. compressor 18) degradation. Once the inlet to the turbine 22 reaches a predetermined temperature, one or more operators or technicians may be notified that the gas turbine engine 10 should be serviced according to further steps of process 100. In some embodiments, a notification is provided on a control panel or dash of the aviation vehicle to which the gas turbine engine 10 is attached to indicate when the gas turbine engine 10 should be serviced or maintained according to further steps of process 100. In some embodiments, pressure and/or flow rate across each stage 26 are monitored and measured using sensors.

In some embodiments, compressor speed is monitored and measured at a set, predetermined torque or thrust setting of the gas turbine engine 10. The compressor speed may be compared to a predetermined speed of the compressor at the predetermined torque or thrust setting. If the measured speed is greater than a predetermined speed that is set for the engine at the predetermined torque or thrust, then this could mean that the gas turbine engine 10 has suffered degradation.

Once it is determined that the gas turbine engine 10 has experienced engine degradation, the process 100 continues with a step 108 of testing the gas turbine engine to determine a performance sensitivity of the compressor 18. The performance sensitivity is indicative of an efficiency of the compressor 18 as a whole or individual efficiencies across each stage 26. Determining the efficiencies of the compressor represents an amount of engine degradation that the compressor has experienced. Performance sensitivities of the compressor may be determined by comparing changes in vane scheduling to the compressor's 18 performance parameters, such as efficiency, flow, speed, and/or surge line as the vanes 32 in each operation condition of the gas turbine engine 10. The performance sensitivity may be derived at a set number of fixed corrected speeds as the sensitives may be non-linear across the speed range of the compressor 18.

The step 108 of testing the gas turbine engine 10 may be performed while the gas turbine engine 10 is coupled to the an airframe of the aviation vehicle. In other embodiments the step 108 of testing the gas turbine engine 10 is performed after the gas turbine engine 10 is removed from the aviation vehicle and placed on a test stand. During the step 108 of testing, the plurality of stages 26 are operated and manipulated across a range of operation conditions of the gas turbine engine (i.e. engine speed). The plurality of vanes 32 are pivoted and engine responses are monitored and recorded to determine the performance sensitivity of the compressor 18 and/or gas turbine engine 10. In one embodiment, each stage 26 of vanes is pivoted by a series of diagnostic vane movers each having different movement paths relative to one another. In other embodiments, each stage of vanes is pivoted by individual actuators while the gas turbine engine 10 is on a test stand. In each embodiment, test responses are obtained and stored to determine the performance sensitivity of the compressor 18. The step 108 of testing may include comparing the test responses to predetermined, initial values of the compressor indicative of engine performance when the compressor has no engine degradation. Comparing the test responses to the initial values determines an amount and/or type of engine degradation so that the bespoke vane mover 14 can be formed to correct or mitigate that engine degradation.

Operation history of the gas turbine engine 10 may affect the engine performance sensitivity, so the step 108 of testing may also include determining engine degradation based at least in part on the operation history of the gas turbine engine 10. The process 100 may also include a step 110 of storing all of the data obtained during the step 108 of testing so that the engine responses during the step 108 of testing can be used to form the bespoke vane mover 14.

The process 100 further includes a step 112 of forming the bespoke vane mover 14 based on the performance sensitivity and/or operation history of the compressor 18 and/or the gas turbine engine 10. The bespoke vane mover 14 is formed to include the adjusted first-stage slot 250 and the adjusted second-stage slot 252. The adjusted first-stage slot 250 is formed to provide a third movement path for the first stage of variable vanes 46 different than the first movement path. The adjusted second-stage slot 252 is formed to provide a fourth movement path for the second stage of variable vanes 48 different than the second movement path. The adjusted first-stage and second-stage slots 250, 252 are shaped relative to the side edges 254, 256 of the bespoke vane mover 14 depending on the engine performance sensitivity of each stage 26 of the compressor 18.

The process 100 further includes a step 114 of replacing the vane mover in the compressor with the bespoke vane mover 14 to increase an efficiency of the compressor without replacing the first stage of variable vanes 46, the second stage of variable vanes 48, or any rotating blades 30 in the compressor 18. Prior to the engine degradation, the first and second movement paths maximize an efficiency of the compressor 18. However, after the engine degradation has occurred, the third and fourth movement paths maximize an efficiency of the compressor 18. Once installed on the gas turbine engine 10, the bespoke vane mover 14 returns the compressor 18 to a higher efficiency compared to an efficiency of the compressor 18 with the original vane mover 40 and after engine degradation. The gas turbine engine 10 may be reused with the bespoke vane mover 14 at a step 116 to increase a usable lifespan of the gas turbine engine 10 and decrease performance losses such as excessive fuel burn, pressure losses, etc. The adjusted first-stage slot 250 and the adjusted second-stage slot 252 cause the gas turbine engine 10 to output adjusted responses indicative that the gas turbine engine 10 has an efficiency greater than the efficiency of the engine with engine degradation and before replacement of the vane mover 40 with the bespoke vane mover 14.

In some embodiments, the process 100 further includes a step 118 of storing a design of the adjusted first-stage and second-stage slots 250, 252 of the bespoke vane mover 14. This information can be stored in a database or server, for example. The process 100 may further include a step 120 of associating the design of the adjusted first-stage and second-stage slots 250, 252 of the bespoke vane mover 14 with the engine degradation and operation history of the gas turbine engine 10 obtained during steps 106 and 108. This information can also be stored in the database or server. The stored data can be used to maintain other gas turbine engines 10 determined to have the same or similar engine characteristics and/or operation history. As such, the process 100 may include a step of replacing a vane mover (i.e. vane mover 40) of a second gas turbine engine having a substantially similar operation history and/or performance sensitivity with a second bespoke vane mover (i.e. bespoke vane mover 14) having substantially similar adjusted first-stage and second-stage slots 250, 252.

In one example, the aerial vehicle to which the gas turbine engine 10 is attached includes at least two gas turbine engines, each of which is substantially similar. If it is determined that both gas turbine engines have the same or similar operation history, then only one gas turbine engine may proceed through process 100 and a bespoke vane mover 14 may be formed for each gas turbine engine. In other embodiments, a separate aerial vehicle may include a similar gas turbine engine. During the process, it may be determined that the similar gas turbine engine experienced the same or similar engine degradation and/or operation history to gas turbine engine 10. Accordingly, the bespoke vane mover 14 design may be retrieved from the database and used to form a bespoke vane mover 14 for the second gas turbine engine.

The adjusted first-stage slot 250 and the adjusted second-stage slot 252 can be shaped and oriented differently depending on the particular engine degradation experienced by the gas turbine engine 10 in order to maximize the efficiency of the compressor 18 using process 100. As shown in FIG. 4, an aft end of the adjusted first-stage slot 250 is closer to a first circumferential side 254 and farther from a second circumferential side 256 of the bespoke vane mover 14 compared to the original first stage slot 50. This change causes the first stage of variable vanes 46 to open more when the actuator 38 is in the fully-retracted position thereby increasing the flow rate between the vanes of the first stage 46. An aft end of the adjusted second-stage slot 252 is farther from the first circumferential side 254 and closer to the second circumferential side 256 of the bespoke vane mover 14 compared to the original second stage slot 52. This change causes the second stage of variable vanes 48 to open less when the actuator 38 is in the fully-retracted position.

Figure 5:
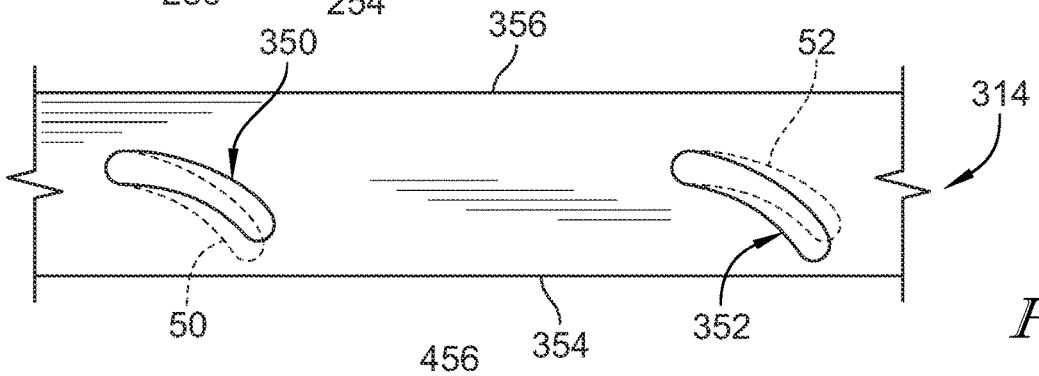
FIG. 5 is top view of the vane mover from FIG. 4 with dashed lines indicating other adjusted guide slots that can be formed in the bespoke vane mover based on different performance sensitivity and/or operation history of the gas turbine engine.

Another embodiment of a bespoke vane mover 314 is shown in FIG. 5. The bespoke vane mover 314 is substantially similar to bespoke vane mover 14. Accordingly similar reference numbers in the 300 series are used to reference similar features between bespoke vane mover 314 and bespoke vane mover 14 and the differences are described below.

The bespoke vane mover 314 is formed to include an adjusted first-stage slot 350 and an adjusted second-stage slot 352 as shown in FIG. 5. An aft end of the adjusted first-stage slot 350 is farther from a first circumferential side 354 and closer to a second circumferential side 356 of the bespoke vane mover 14 compared to the original first stage slot 50. The adjusted first-stage slot 350 has a smaller slope compared the original first stage slot 50. This change causes the first stage of variable vanes 46 to open less when the actuator 38 is in the fully-retracted position. An aft end of the adjusted second-stage slot 352 is closer to the first circumferential side 354 and farther from the second circumferential side 356 of the bespoke vane mover 14 compared to the original second stage slot 52. The adjusted second-stage slot 352 has a greater slope compared the original second stage slot 52. This change causes the second stage of variable vanes 48 to open more when the actuator 38 is in the fully-retracted position thereby increasing the flow rate between the vanes of the second stage 48. The adjusted first-stage slot 350 has a different curvature compared to the first stage slot 50. The adjusted second-stage slot 352 has a different curvature compared to the second stage slot 52.

Figure 6:
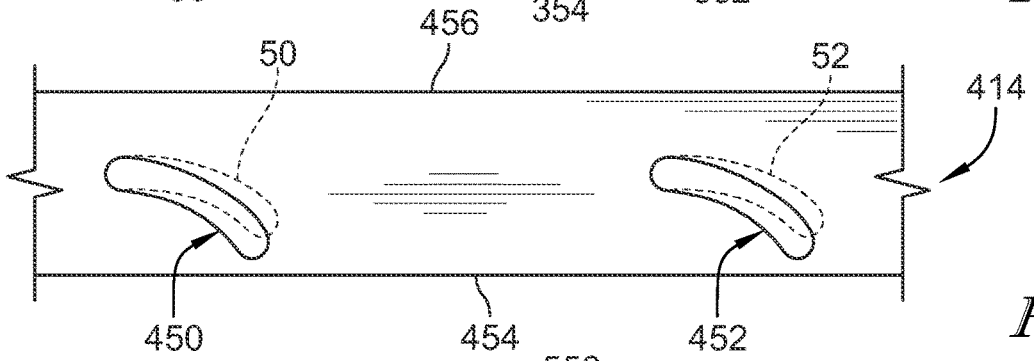
FIG. 6 is top view of the vane mover from FIG. 4 with dashed lines indicating other adjusted guide slots that can be formed in the bespoke vane mover based on different performance sensitivity and/or operation history of the gas turbine engine.

Another embodiment of a bespoke vane mover 414 is shown in FIG. 6. The bespoke vane mover 414 is substantially similar to bespoke vane mover 14. Accordingly similar reference numbers in the 400 series are used to reference similar features between bespoke vane mover 414 and bespoke vane mover 14 and the differences are described below.

The bespoke vane mover 414 is formed to include an adjusted first-stage slot 450 and an adjusted second-stage slot 452 as shown in FIG. 6. An aft end of the adjusted first-stage slot 450 is closer to a first circumferential side 454 and farther from a second circumferential side 456 of the bespoke vane mover 14 compared to the original first stage slot 50. The adjusted first-stage slot 450 has a greater slope compared the original first stage slot 50. This change causes the first stage of variable vanes 46 to open more when the actuator 38 is in the fully-retracted position. An aft end of the adjusted second-stage slot 452 is also closer to the first circumferential side 454 and farther from the second circumferential side 456 of the bespoke vane mover 14 compared to the original second stage slot 52. The adjusted second-stage slot 452 has a greater slope compared the original second stage slot 52. This change causes the second stage of variable vanes 48 to open more when the actuator 38 is in the fully-retracted position thereby increasing the flow rate between the vanes of the second stage 48. The adjusted first-stage slot 450 has a different curvature compared to the first stage slot 50. The adjusted second-stage slot 452 has a different curvature compared to the second stage slot 52.

Figure 7:
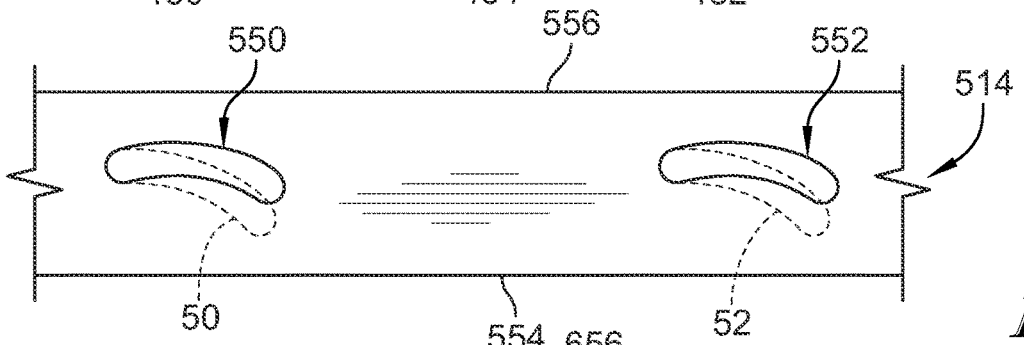
FIG. 7 is top view of the vane mover from FIG. 4 with dashed lines indicating other adjusted guide slots that can be formed in the bespoke vane mover based on different performance sensitivity and/or operation history of the gas turbine engine.

Another embodiment of a bespoke vane mover 514 is shown in FIG. 7. The bespoke vane mover 514 is substantially similar to bespoke vane mover 14. Accordingly similar reference numbers in the 500 series are used to reference similar features between bespoke vane mover 514 and bespoke vane mover 14 and the differences are described below.

The bespoke vane mover 514 is formed to include an adjusted first-stage slot 550 and an adjusted second-stage slot 552 as shown in FIG. 7. An aft end of the adjusted first-stage slot 550 is farther from a first circumferential side 554 and closer to a second circumferential side 556 of the bespoke vane mover 14 compared to the original first stage slot 50. The adjusted first-stage slot 550 has a smaller slope compared the original first stage slot 50. This change causes the first stage of variable vanes 46 to open less when the actuator 38 is in the fully-retracted position. An aft end of the adjusted second-stage slot 552 is also farther from the first circumferential side 554 and closer to the second circumferential side 556 of the bespoke vane mover 14 compared to the original second stage slot 52. The adjusted second-stage slot 552 has a smaller slope compared the original second stage slot 52. This change causes the second stage of variable vanes 48 to open less when the actuator 38 is in the fully-retracted position. The adjusted first-stage slot 550 has a different curvature compared to the first stage slot 50. The adjusted second-stage slot 552 has a different curvature compared to the second stage slot 52.

Figure 8:
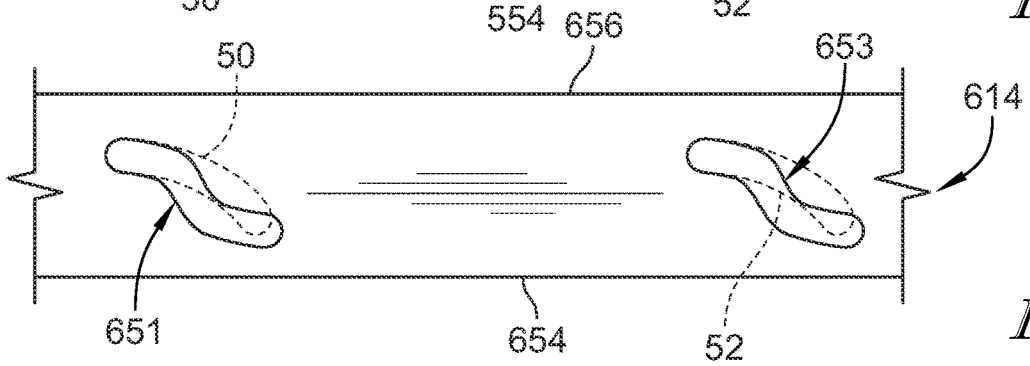
FIG. 8 is top view of another embodiment of a vane mover including first and second stage guide slots and showing dashed lines indicating adjusted guide slots that can be formed in the bespoke vane mover based on different performance sensitivity and/or operation history of the gas turbine engine.

Another embodiment of a bespoke vane mover 614 is shown in FIG. 8. The bespoke vane mover 614 is substantially similar to bespoke vane mover 14. Accordingly similar reference numbers in the 600 series are used to reference similar features between bespoke vane mover 614 and bespoke vane mover 14 and the differences are described below.

The bespoke vane mover 614 is formed to include an adjusted first-stage slot 651 and an adjusted second-stage slot 653 as shown in FIG. 8. The adjusted slots 651, 653 have a different shape compared to first stage and second stage slots 50, 52. Each adjusted slot 651, 653 is generally Z-shaped when looking radially at the bespoke vane mover 614. The adjusted slots 651, 653 can have any suitable shape to increase the efficiency of the compressor 18 using process 100 after engine degradation has occurred.

In some embodiments, actuation systems (i.e. vane actuator system 28) to control variable geometry may include a torque tube system which drives a linear relationship between the multiple stages 26 of variable stator vane (VSV) geometry. In some embodiments, each variable stator vane would be individually controlled to a desired vane angle that minimizes the losses across that stage. The present disclosure achieves stage by stage non-linear relationships by providing a VSV cam plate 40 including a translating plate with uniquely defined cam paths that prescribe the amount of variability for each vane.

In some embodiments, the present disclosure utilizes the cam plate design for engine deterioration performance management. Over the life of gas turbine engines the compressor 18 may deteriorate. The compression system 18 deterioration may be evident by a loss in specific fuel consumption due to a reduction in component efficiency. Component efficiency loss is attributed to many factors, one of which being the erosion and aerodynamic mismatch from blade row to blade row of each stage 26. This factor may also lead to a loss in stall margin and/or loss in flow rate at a given rotational speed, leading to elevated temperatures in the hot section to satisfy engine power demands. Eventually the level of performance loss may result in an engine overhaul and rebuild of the compression system 18.

In some embodiments, by utilizing a cam plate system 40, it is possible to re-tune the compression system 18 by introducing a different cam plate 14, 314, 414, 514, 614 with an optimized set of paths 250, 252, 350, 352, 450, 452, 550, 552, 650, 652 for the deteriorated engine, thereby accounting for some or all of the mismatch in the compression system 18 from stage to stage. The overhauled cam plate 14, 314, 414, 514, 614 would avoid the costly overhaul of a new compression system. One could pre-empt an overhaul and introduce a new cam plate 14, 314, 414, 514, 614 without an engine removal with a reliable digital twin of the compression system and a robust understanding of the observed deterioration.

In some embodiments, one current method of gauging gas turbine performance degradation is to monitor turbine inlet temperature. As an engine deteriorates, more fuel may be burned to make the required power which raises the temperature of the air entering the turbine. Once the engine reaches a specified temperature, it is sent to an overhaul facility where it is removed from the airframe, tested to verify performance, then taken apart and rebuilt. Compressor component deterioration figures into the overall performance degradation prominently, through inlet flow reduction and component efficiency drops. Both of these quantities can be adversely affected by dirt, blade tip and seal clearances, changes and erosion of blade cross-sectional shapes, etc. Dirt can be washed out of the compressor 18, but the other changes cause internal adjustments to the amount of work (pressure ratio) performed by each compressor stage 26. These individual work adjustments cause the compressor to rematch, disrupting the design-intent stage matching of the compressor 18.

In some embodiments, each stage is designed with the expectation that neighboring stages will perform the work expected of them. Some compressors have the capability to redistribute stage work through the use of variable stator vanes, but this is typically done to keep the engine running optimally at different speeds and not for component deterioration. Some linkages used for variable stator vane control in other gas turbine engines are complicated and do not lend themselves for easy adjustment. The use of a cam plate 40, 14 avoids all of this complication and allows easy changes to the variable vane motion.

In some embodiments, the present disclosure takes advantage of the variable stator vanes to aid in regaining some of the performance lost through the various causes of deterioration. This process can be performed by individually manipulating the variable vanes on the engine during operation and monitoring the response. Comparing the engine response to a database of performance sensitivities allows the diagnosis for the performance shortfall and new vane setting angles can be determined to regain performance. Each engine tested in this fashion can be re-tuned to optimal performance by adjusting the cam plate paths to yield the desired schedule.

In some embodiments, the engine performance sensitivity can be performed in a variety of ways. The engine can be removed from the airframe and placed on a test stand. Individual actuators would be placed on each variable stator vane row and the performance analysis carried out in a controlled environment. This may be the quickest way of achieving the performance enhancements. Another method may be to create a series of diagnostic cam plates, which could be installed on the engine in series. The results of these individual runs would be collected and compared to the sensitivity database to determine where the largest performance shortfall lies. One benefit of using the diagnostic cam plates is the engine would not have to be taken off of the airframe in order to perform the analysis. In both instances, a new cam plate containing the optimized vane paths could be manufactured quickly and installed with minimal effort.

In some embodiments, another benefit provided by the present disclosure is the process 100 could be applied at any time rather than waiting for the engine deterioration to reach serious levels. If this process 100 were to be employed during regular maintenance cycles, engine output could be kept at higher levels, resulting in better performance and lower fuel burn over the life of the engine. This performance improvement may result in lower operating costs. The present disclosure includes the utilization of cam plate tuning for overhaul and performance deterioration recovery as well as the method by which the compressor performance can be functionally restored.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A method of maintaining at least one gas turbine engine, the method comprising providing a compressor of the gas turbine engine, the compressor including: (i) a compressor case at least partially defining a flow path, (ii) a plurality of stages including a first stage of variable vanes extending into the flow path and a second stage of variable vanes extending into the flow path and spaced apart from the first stage of variable vanes, and (iii) a vane actuator system including a pair of vane rings, each vane ring coupled to each variable vane of a corresponding stage of variable vanes, an actuator configured to move each vane ring based on engine operating conditions, and a vane mover interconnecting the actuator and each vane ring to transfer movement of the actuator to each of the vane rings, the vane mover including a first-stage slot providing a first movement path for the first stage of variable vanes and a second-stage slot providing a second movement path for the second stage of variable vanes, monitoring the compressor for degradation by measuring at least one of temperature, pressure, and flow rate in the gas turbine engine and comparing the at least one of temperature, pressure and flow rate to a threshold value, testing the gas turbine engine after the threshold value is reached to determine a performance sensitivity of the compressor by actuating the first and second stages of vanes and collecting pressure values and flow rate values at each stage, forming a bespoke vane mover based on the performance sensitivity of the compressor, the bespoke vane mover having an adjusted first-stage slot providing a third movement path for the first stage of variable vanes different than the first movement path and an adjusted second-stage slot providing a fourth movement path different than the second movement path, and replacing the vane mover in the compressor with the bespoke vane mover to increase an efficiency of the compressor without replacing the first stage of variable vanes or the second stage of variable vanes, wherein the step of testing includes pivoting each of the first-stage variable vanes and each of the second stage variable vanes, measuring responses of the compressor to determine test values indicative of the performance sensitivity of the compressor, and comparing the test values to predetermined, initial values of the compressor indicative of engine performance when the compressor has no engine degradation.

2. The method of claim 1, further comprising obtaining operation history of the gas turbine engine including at least one of flight history, location history, rest history, and service history.

3. The method of claim 2, wherein the step of forming the bespoke vane mover is based on both the performance sensitivity and the operation history of the gas turbine engine.

4. The method of claim 1, further comprising a step of storing the performance sensitivity and the bespoke vane mover design in a database and associating the performance sensitivity with the bespoke vane mover design in the database.

5. The method of claim 4, further comprising a step of replacing a vane mover of a second gas turbine engine having a substantially similar operation history or performance sensitivity with a second bespoke vane mover having substantially similar adjusted first-stage and second-stage slots.

6. The method of claim 1, wherein the step of testing is performed while the engine is mounted on an airframe of an aerial vehicle and the step of pivoting each of the first stage variable vane and each of the second stage variable vanes includes installing a series of diagnostic vane movers each having different movement paths, and the step of comparing includes comparing test values for each diagnostic vane mover.

7. The method of claim 1, wherein the step of testing includes removing the gas turbine engine from an airframe of an aerial vehicle and the step of pivoting is performed by an individual actuator for each stage of variable vanes.

8. A method comprising operating a compressor of a gas turbine engine, the compressor including (i) a compressor case at least partially defining a flow path, (ii) a plurality of stages including a first stage of variable vanes extending into the flow path and a second stage of variable vanes extending into the flow path and spaced apart from the first stage of variable vanes, and (iii) a vane actuator system including a pair of vane rings, each vane ring coupled to each variable vane of a corresponding stage of variable vanes, an actuator configured to move each vane ring based on engine operating conditions, and a vane mover interconnecting the actuator and each vane ring to transfer movement of the actuator to each of the vane rings, the vane mover including a first-stage slot providing a first movement path for the first stage of variable vanes and a second-stage slot providing a second movement path for the second stage of variable vanes, replacing the first vane mover with a second vane mover having different movement paths than the first vane mover, and operating the compressor of the gas turbine engine after the replacing step.

further comprising determining that the gas turbine engine has experienced degradation by measuring at least one of temperature, pressure, and flow rate in the gas turbine engine and comparing the at least one of temperature, pressure and flow rate to a threshold value and testing the gas turbine engine after the threshold value is reached to determine a performance sensitivity of the compressor by actuating the first and second stages of vanes and collecting pressure values and flow rate values at each stage, and further comprising the step of storing the performance sensitivity and the bespoke vane mover design in a database and associating the performance sensitivity with the second vane mover design in the database.

9. The method of claim 8, further comprising forming the second vane mover based on the performance sensitivity, the second vane mover having an adjusted first-stage slot providing a third movement path for the first stage of variable vanes different than the first movement path and an adjusted second-stage slot providing a fourth movement path different than the second movement path.

10. The method of claim 9, further comprising a step of obtaining an operation history of the gas turbine engine including at least one of flight history, location history, rest history, and service history.

11. The method of claim 10, wherein the step of forming the second vane mover is based on the performance sensitivity and the operation history of the gas turbine engine.

12. The method of claim 8, further comprising a step of replacing a vane mover of a second gas turbine engine having a substantially similar operation history or performance sensitivity with a copy of the second vane mover having substantially similar adjusted first-stage and second-stage slots.

13. The method of claim 8, wherein the step of testing includes pivoting each of the first-stage variable vanes and each of the second stage variable vanes, measuring responses of the compressor to determine test values indicative of the performance sensitivity of the compressor, and comparing the test values to predetermined, initial values of the compressor indicative of engine performance when the compressor has no engine degradation.

14. The method of claim 13, wherein the adjusted first-stage slot and the adjusted second-stage slot cause the gas turbine engine to return to an efficiency level above what the gas turbine engine had prior to replacing the vane mover with the bespoke vane mover.

15. A gas turbine engine kit comprising a compressor for a gas turbine engine, the compressor including (i) a compressor case at least partially defining a flow path, (ii) a plurality of stages including a first stage of variable vanes extending into the flow path and a second stage of variable vanes extending into the flow path and spaced apart from the first stage of variable vanes, and (iii) a vane actuator system including a pair of vane rings, each vane ring coupled to each variable vane of a corresponding stage of variable vanes, an actuator configured to move each vane ring based on engine operating conditions, and a vane mover interconnecting the actuator and each vane ring to transfer movement of the actuator to each of the vane rings, the vane mover including a first-stage slot providing a first movement path for the first stage of variable vanes and a second-stage slot providing a second movement path for the second stage of variable vanes, and a bespoke vane mover having an adjusted first-stage slot providing a third movement path for the first stage of variable vanes different than the first movement path and an adjusted second-stage slot providing a fourth movement path different than the second movement path, wherein the slope of the adjusted first-stage slot and the slope of the adjusted second-stage slot are based on performance sensitivity of the compressor and operation history of the gas turbine engine, wherein the performance sensitivity is calculated by actuating the first and second stages of vanes and collecting pressure values and flow rate values at each stage, and the operation history of the gas turbine engine includes at least one of flight history, location history, rest history, and service history.

16. The kit of claim 15, wherein the first stage slot has a first slope relative to circumferential edges of the vane mover and the adjusted first-stage slot has a second slope different than the first slope, and wherein the second stage slot has a third slope relative to circumferential edges of the vane mover and the adjusted first-stage slot has a fourth slope different than the third slope.

17. The kit of claim 15, wherein the first stage slot has a first curvature relative to circumferential edges of the vane mover and the adjusted first-stage slot has a second curvature different than the first curvature, and wherein the second stage slot has a third curvature relative to circumferential edges of the vane mover and the adjusted first-stage slot has a fourth curvature different than the third curvature.

* * * * *